US006409324B1

(12) United States Patent
Hsu et al.

(10) Patent No.: US 6,409,324 B1
(45) Date of Patent: Jun. 25, 2002

(54) METHOD AND APPARATUS FOR SUPPLYING INK TO AN PRINTHEAD

(75) Inventors: Cheng-Wei Hsu, Tainan Hsien; Shyh-Haur Su, Hsinchu; Chieh-Wen Wang, Hsinchu; I-Chung Hou, Hsinchu; Charles C. Chang, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/714,068

(22) Filed: Nov. 16, 2000

(30) Foreign Application Priority Data

Jan. 28, 2000 (TW) ..... 89101463 A

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 4,017,871 A * 4/1977 Hubbard ..... 346/140.1
4,771,295 A * 9/1988 Baker et al. ..... 347/87
5,489,932 A * 2/1996 Ceschin et al. ..... 347/87

FOREIGN PATENT DOCUMENTS

EP 0822085 A2 * 4/1998 ..... B41J/2/175
JP .404007157 A * 1/1992 ..... B41J/2/175

* cited by examiner

*Primary Examiner*—Anh T. N. Vo
(74) *Attorney, Agent, or Firm*—Darby & Darby

(57) ABSTRACT

The ink cartridge of the present invention uses a directional fibrous collection enclosed within a bushing to temporally retain the ink therein, wherein at least one controlled capillary portion is provided. The controlled capillary portion can be formed by the bushing or by a predetermined shape located in the cartridge. The capillary forces of the controlled capillary portion are stronger than the one of other portion of the directional fibrous collection. The flow rate of the ink can be precisely controlled by the directional fibrous collection, and the controlled capillary portion can efficiently drain out the ink to the printhead and there is no bubble left therein.

9 Claims, 3 Drawing Sheets

METHOD AND APPARATUS FOR SUPPLYING INK TO AN PRINTHEAD

BACKGROUND OF THE INVENTION

1. Field of the invention

This invention relates to an ink cartridge. More particularly, this invention relates to an ink cartridge provided with at least one controlled capillary portion located in a directional fibrous collection.

2. Description of Prior Art

In general, porous materials such as sponge are currently used to store the ink in printing devices, and porous materials also can provide adequate back pressure to stabilize the ink stored in the cartridge.

U.S. Pat. No. 4,771,295 discloses a porous material used to store ink within an ink cartridge. The porous material is pressed by an ink pipe so as to generate more capillary force to facilitate the flow rate of the ink.

However, for properly fitting the porous material in the cartridge, the porous material should be first prestressed by well-designed fixtures. Although a greater bulk of porous material can hold more ink, the residual ink is also relatively larger. Furthermore, as the ink stored in the porous material is consumed, some of the bubbles cannot be fully expelled out off the porous material. Residual bubbles in the porous material may cause the interruption of the ink supplied to the printhead.

SUMMARY OF THE INVENTION

To solve the above problem, the primary object of this invention is to provide an ink cartridge using a directional fibrous collection enclosed within a bushing to retain the ink therein and provided with at least one controlled capillary portion. The controlled capillary portion can be formed by the bushing or by a predetermined shape located in the cartridge. The capillary forces of the controlled capillary portion are stronger than those of other portions of the directional fibrous collection. Thus, the flow rate of the ink can be precisely controlled, and the controlled capillary portion can efficiently drain out the ink to the printhead and there is no bubble left therein.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1A:
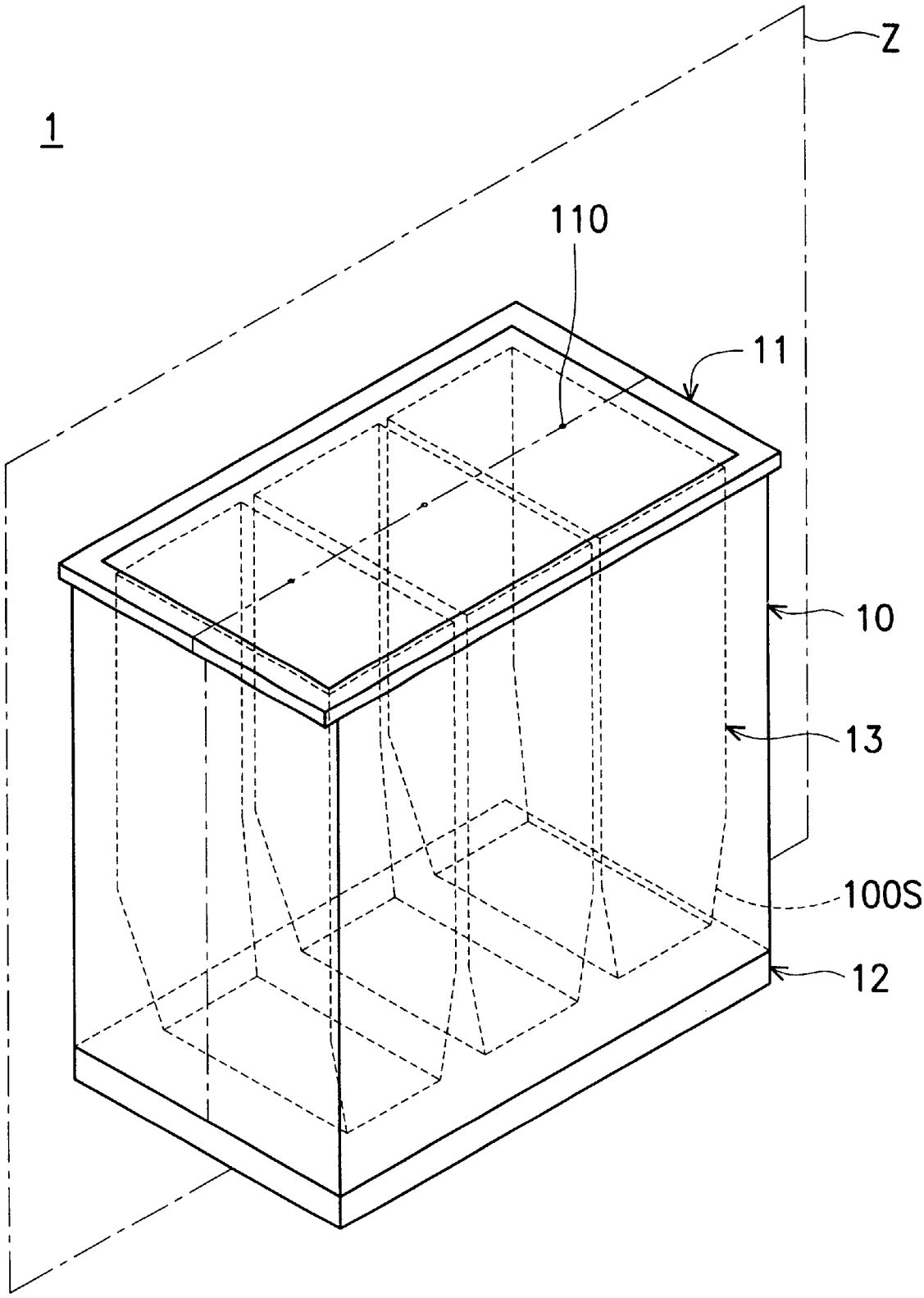
FIG. 1A is a perspective view showing the structure of an ink cartridge (1)
Figure 1B:
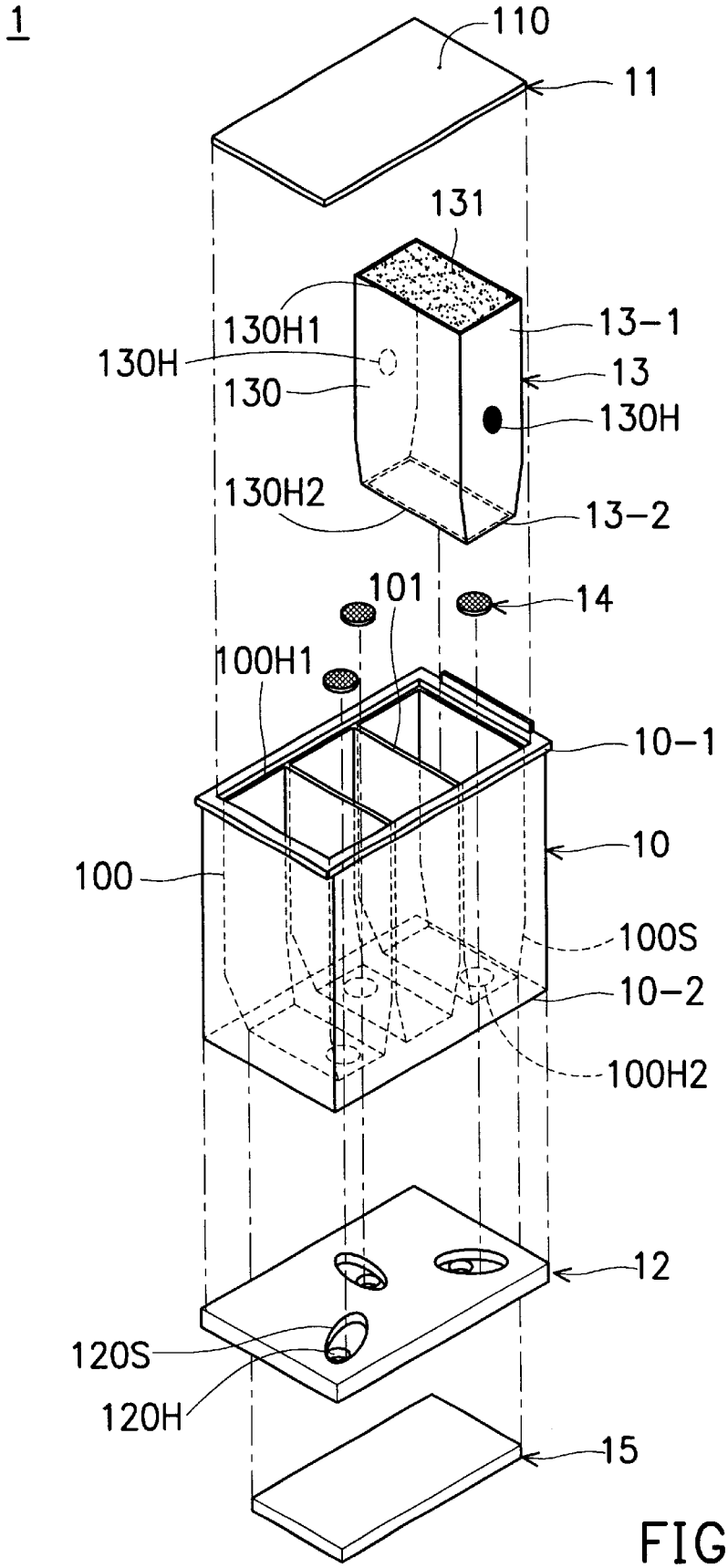
FIG. 1B is an exploded view of FIG. 1A.

FIG. 1A is a perspective view showing the structure of an ink cartridge 1, and FIG. 1B is an exploded view of FIG. 1A.

As shown in FIG. 1A, the ink cartridge 1 comprises a container 10, a cover plate 11 provided with holes 110, a base plate 12 and several storage units 13 received in the container 10.

In FIG. 1B, a printhead 15 such as printhead is connected to the base plate 12, and the base plate 12 is used as a guiding member to guide the ink from the container 10 to the printhead 15. Then, the ink is jetted out by the printhead 15 and printed on the paper.

The container 10 comprises a plurality of chambers 100 therein separated from each other by a partition 101. The chambers 100 are independent to each other, and each of which is formed with a first opening 100H1 located on the top of the container 10 and a second opening 100H2 located on the bottom of the container 10. The inside of each of the chambers 100 has a reductive portion 100S nearby its the second opening 100H2, and the second opening 100H2 is covered with a filter 14.

The storage unit 13 comprises a bushing 130 and a directional fibrous collection composed of fibers 131 to temporally keep the ink therebetween. The bushing 130 preferably is made of flexible material such as plastic and has at least one hole 130H formed at its sidewall and two openings 130H1 (130H2) located at its two ends 13-1 (13-2), respectively. The fibers 131 are tensely gathered and enclosed by the bushing 130, and the ends of the fibers 131 are exposed at the two openings 130H1, 130H2. When the fibers 131 wrapped with the bushing 130 are placed in the chamber 100, the openings 130H1, 130H2 of the bushing 130 are respectively adjacent to the first opening 100H1 and the second opening 100H2 of the container 10. Further, with the formation of the reductive portion 100S, a controlled capillary portion is generated nearby the second opening 100H2 of the bushing 130. That is to say, the reductive portion 100S squeezes the fibers 131 located at the end 13-2 of the bushing 130 while the storage unit 13 is placed in the chamber 100. Therefore, the fiber density of fibers 131 at the controlled capillary portion 131 A nearby the hole 100H2 is greater than that of the other region 131B away from hole 100H2. Therefore, the capillary forces at this region are larger than the other regions of the fibers 131 within the bushing 130.

In addition, the controlled capillary portion of the fibers 131 also can be formed by a bushing or a sleeve which is made of rigid material.

The base plate 12 is provided with several paths 120S and holes 120H and disposed on the bottom of the container 10. The hole 120H located at the path 120S penetrates the base plate 12, and each of the paths 120S is connected to the corresponding second openings 100H2 of the chamber 100. The ink from the chamber 100 can be guided to the printhead 15 via the path 120S and the hole 120H.

Figure 2:
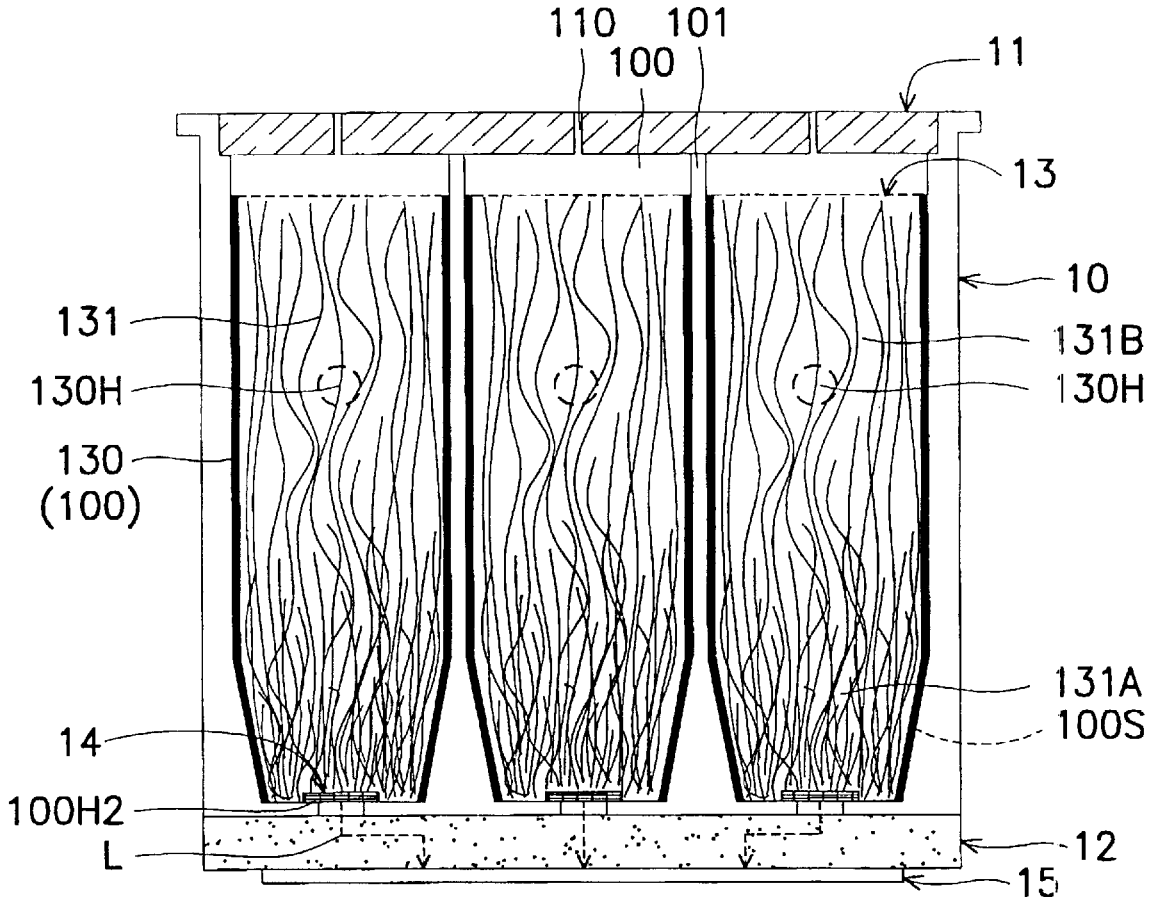
FIG. 2 is a sectional view showing the inner structure of the ink cartridge (1) according to a plane (Z) of FIG. 1A.

Referring to FIG. 2, a sectional view shows the inner structure of the ink cartridge 1 according to a plane Z of FIG. 1A.

In FIG. 2 the ink stored in the chamber 100 passes through the filter 14 and is then transmitted to the printhead 150 through the base plate 12 along the line L. The oozing ink being left between the inner wall of the chamber 100 and the bushing 130 can be easily absorbed by the fibers 131 via the hole 130H. The capillary forces of the storage unit 13 become stronger at the controlled capillary portion capillary forces, and therefore the flow rate of the ink can be precisely controlled and the ink can be efficiently drained out by the controlled capillary portion.

In addition to the aforementioned controlled capillary portion of the fibers 131 which is formed by the bushing 130, the controlled capillary portion of the storage units 13 also can be formed by the shape of the inner wall of the chamber 100 of container 10. The bushing 130 made of rigid material can be instead of a soft one such as flexible plastics or other films. The method is to provide several ribs or tapered portions (not shown in Figs.), which are spaced each other and formed on the inner wall of the chamber 100. While the wrapped fibers 131 is forcedly fitted into the chamber 100, the controlled capillary portion can be naturally formed by these ribs or tapered portions.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for supplying ink to a printhead, comprising:

a container having an opening connected to said printhead;

a storage chamber in said container;

a bushing comprising at least one hole formed on a sidewall of said bushing; and a plurality of directional fibers disposed in said bushing and provided with a first controlled capillary portion and a second portion, said first controlled capillary portion having a higher fiber density than said second portion, wherein the directional fibers receive and store said ink; and wherein said first controlled capillary portion guides said ink from said second portion to said opening.

2. The apparatus as claimed in claim 1, wherein said bushing further comprises a reduced segment for compressing a portion of the plurality of directional fibers to form said first controlled capillary portion.

3. The apparatus of claim 2 wherein said bushing is tapered to form the reduced segment.

4. The apparatus as claimed in claim 1 wherein said storage chamber further comprises a reduced segment for compressing a portion of the plurality of the directional fibers to form said first controlled capillary portion.

5. The apparatus of claim 4 wherein said storage chamber is tapered to form the reduced segment.

6. A method for supplying ink to a printhead, comprising the steps of:

connecting an opening of a container having a storage chamber to said printhead;

enclosing said storage chamber with a bushing comprising at least one hole;

providing a first controlled capillary portion and a second portion with the directional fibers, wherein said first controlled capillary portion has a higher fiber density than said second portion;

receiving and storing said ink in the directional fibers; and guiding said ink from said second portion to said opening using said first controlled capillary portion.

7. The method as claimed in claim 6 further comprising the step of forming said first controlled capillary portion by said bushing.

8. The method of claim 6 further comprising the step of tapering said storage chamber to form the reduced segment.

9. The method of claim 6 further comprising the step of tapering said bushing to form the reduced segment.

* * * * *